United States Patent [19]

Jeuneu

[11] Patent Number: 4,758,697

[45] Date of Patent: Jul. 19, 1988

[54] INTERMITTENT SUPPLY CONTROL DEVICE FOR ELECTRIC APPLIANCES OF IN PARTICULAR A HOTEL ROOM

[75] Inventor: Patrick Jeuneu, Neuilly-sur-Seine, France

[73] Assignee: Societe Internationale de Promotion Commerciale, Paris, France

[21] Appl. No.: 31,184

[22] Filed: Mar. 30, 1987

Related U.S. Application Data

[63] Continuation of Ser. No. 757,834, filed as PCT FR84/00247, Nov. 5, 1984, published as WO85/02054, May 9, 1985, abandoned.

[30] Foreign Application Priority Data

Nov. 4, 1983 [FR] France ..... 83 17577

[51] Int. Cl.[4] ..... H01H 27/06; H01H 9/00; E05B 65/00

[52] U.S. Cl. ..... 200/61.64; 200/43.01; 200/61.68; 70/57; 335/205

[58] Field of Search ..... 200/42.01, 42.02, 43.01, 200/43.02, 43.04–43.07, 43.11, 61.64, 61.67, 61.68, 61.93; 70/134, 156, 142, 143; 292/159, 160, 172, 142; 340/542

[56] References Cited

U.S. PATENT DOCUMENTS

| | | | |
|---|---|---|---|
| 956,580 | 5/1910 | Howard | 200/61.68 |
| 1,211,437 | 1/1917 | Gruber | 292/172 |
| 1,416,485 | 5/1922 | Lurie | 200/61.66 X |
| 1,702,483 | 2/1929 | Phelps | 200/61.68 |
| 2,301,290 | 11/1942 | Knight | 200/61.68 |
| 2,623,133 | 12/1952 | Evans | 200/43.11 |
| 3,235,300 | 2/1966 | McRae et al. | 200/61.67 X |
| 3,245,238 | 4/1966 | Young | 70/134 |
| 3,596,021 | 7/1971 | Saul | 200/61.93 |
| 3,723,677 | 3/1973 | Arias | 200/43.04 |
| 3,803,575 | 4/1974 | Gotanda | 200/61.64 |
| 3,810,145 | 5/1974 | Gusaras | 200/61.67 X |
| 3,870,842 | 3/1975 | Bergsman | 200/61.66 X |
| 3,962,695 | 6/1976 | Peters | 200/61.66 X |
| 4,091,866 | 5/1978 | Curatolo | 200/61.68 X |
| 4,189,692 | 2/1980 | Bonnar | 200/61.67 X |
| 4,232,819 | 11/1980 | Bost | 236/47 |
| 4,333,604 | 6/1982 | Petrillo | 200/61.67 |

FOREIGN PATENT DOCUMENTS

| | | | |
|---|---|---|---|
| 661855 | 7/1929 | France | 292/172 |
| 748043 | 4/1933 | France . | |

*Primary Examiner*—J. R. Scott

*Attorney, Agent, or Firm*—Wenderoth, Lind & Ponack

[57] ABSTRACT

A device for controlling the selective switching on and off of the supply of current to an electric appliance of a premises, particularly a hotel room, includes a door lock having a bolt and a keeper to be mounted in a door and a door frame of an entrance to the premises such that the bolt is movable between first and second locked positions extending into the keeper and an unlocked position withdrawn from the keeper. An electric circuit connects a source of electric current to the electric appliance, and the circuit includes a switch normally closed to allow current to be supplied from the source to the appliance and operable to be opened to interrupt the supply of current from the source to the appliance. The switch is disposed in the keeper. The door lock includes first key-actuated structure, operable only from the exterior of the door, for moving the bolt between the unlocked position and the first locked position, whereat the bolt extends into the keeper by an amount sufficient to open the switch and thereby interrupt the supply of current from the source to the appliance. The door lock additionally includes second key-actuated structure, operable only from the interior of the door, for moving the bolt between the unlocked position and the second locked position, whereat the bolt extends into the keeper by an amount sufficient to lock the door lock but insufficient to open the switch, such that the switch remains closed and current remains supplied from the source to the appliance.

6 Claims, 2 Drawing Sheets

INTERMITTENT SUPPLY CONTROL DEVICE FOR ELECTRIC APPLIANCES OF IN PARTICULAR A HOTEL ROOM application Ser. No. 757,834, filed as PCT FR 84/00247; Nov. 5, 1984, published as WO85/02054, May 9, 1985.

BACKGROUND OF THE INVENTION

The present invention relates to installations supplying electric current to living quarters and more particularly to installations for appliances of high electric consumption such as air conditioners or the like.

In hot countries, which are often holiday or vacation regions, a large number of hotels have been constructed having rooms equipped with air conditioners.

These air conditioners maintain a temperature distinctly lower than the outside temperature and thus enable clients to rest in their room under good conditions.

However, when a client leaves his rrom, he has the unfortunate habit of forgetting to stop the air conditioner, despite requests for doing so marked on the air conditioners.

Consequently, there is a useless operation of air conditioners in the absence of occupation of the premises and this constitutes a considerable consumption of energy and involves expense for the hotel keeper which could be avoided.

In order to overcome these drawbacks, it has been proposed to control the supply of the electric installations of the rooms from the key-board of the hotel reception.

Such an installation requires the use of great lengths of electric conductors connecting the key-board to the rooms.

This drawback is even more serious when the hotel is of the type having bungalows scattered about a ground of large area.

Further, an installation controlled from the control board of the receiption is difficult to install in an existing establishment. Moreover, it does not provide a guarantee of correct operation, since some clients keep their keys so that it cannot be certain whether they occupy their room or not.

An object of the invention is to provide a supply control device for electric appliances of a premises, in particular a hotel room, which is of very moderate cost but can be easily installed both in existing establishments and when constructing new premises.

SUMMARY OF THE INVENTION

The invention therefore provides a supply control device for electric appliances of a premises, in particular a hotel room, comprising a contact or switch inserted in the input circuit of at least a part of the supply network in the premises, said contact being actuated by a device detecting the presence of a person in said premises, wherein the device for detecting the presence of a person in the premises comprises a switch disposed in the keeper of a lock of a door provided with means for closing the door from the exterior and means for closing the door from the interior, said switch being inserted in the circuit actuating said contact and being actuatable by closing means solely from one side of the door.

BRIEF DESCRIPTION OF THE DRAWINGS

A better understanding of the invention will be had from the following description which is given solely by way of example with reference to the accompanying drawings in which.

DETAILED DESCRIPTION

Figure 1:
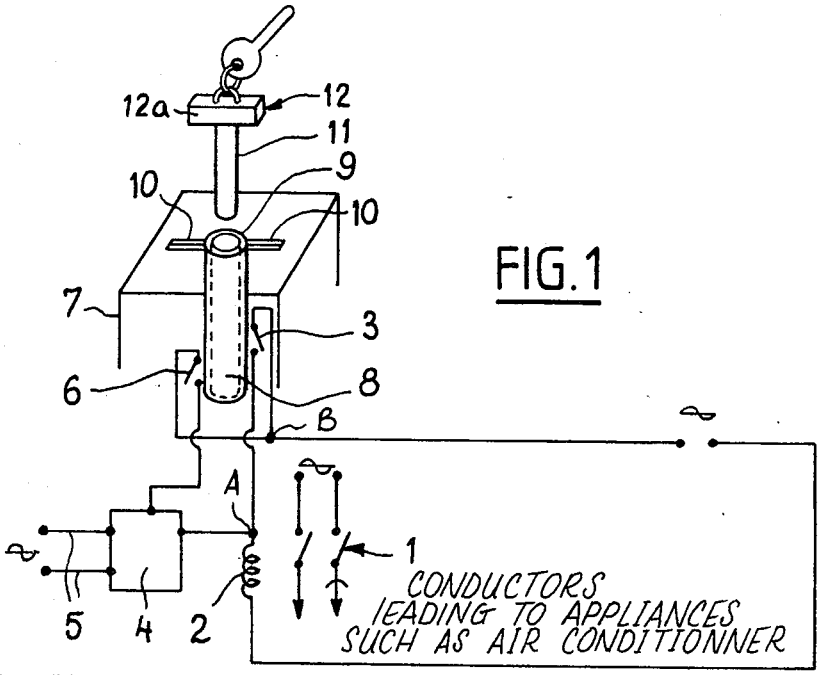
FIG. 1 is an electric diagram of a supply control device according to the invention.

The control device shown in FIG. 1 comprises a contact or swtich 1 inserted in the electric supply network of a premises in respect of which it is desired to achieve the intermittent operation of certain appliances, and in particular an air conditioner (not shown). The switch 1 can advantageously be disposed upstream of the safety fuses of the appliances controlled by the intermittent control device.

The switch 1 is actuated by a coil 2 supplied with current from mains through a magnetically-controlled switch 3. Connected in parallel to the coil 2 is a timer 4, for example a timer of the type known by the reference Legrand 03705, which is supplied with current through conductors 5 from the mains and whose operation is triggered by means of a second magnetically-controlled switch 6 which has a common terminal with the switch 3 connected to the mains.

The magnetically-controlled switches 3 and 6 are placed in a case 7 in which is mounted a tube 8 of insulating material. The upper side of the case 7 has a circular opening 9 extended by diametrically opposed lateral slots 10. The circular part 9 of this opening is disposed in alignment with the upper end of the tube 8 so as to permit the introduction in this tube of a magnet 11 having the shape of a rod actuating the switches 3 and 6. The magnet 11 is advantageously part of a key-ring 12 which comprises, in the presently-described embodiment, a transverse plate **12*a* of such size that it can be engaged in the slots 10 of the upper side of the case 7**.

The switches 3 and 6 are closed by the penetration of the magnet 11 into the insulating tube 8.

The case 7 containing the two switches 3 and 6 can be disposed in the vicinity of the entrance door of a premises at a position enabling an occupant to insert the key-ring in the opening 9 of the case. Its presence may moreover be indicated for example by an indicator light mounted on the case.

This introduction may be rendered obligatory in as much as the device is installed in such manner as to control the lighting of the premises and the air conditioning equipment. Thus, the case 7 with the component parts it contains, perform the function of a device detecting the presence of a person in the premises and remote controlling at least a part of the electric installation thereof.

The device shown in FIG. 1 operates in the following manner:

When the rod-shaped magnet 11 is introduced into the tube 8, it causes the closure of the initially open switches 3 and 6. The closure of the switch 3 results in the supply of current to the coil 2 by the mains and consequently the closure of the contact or switch 1, so that all of the appliances supplied with current by the part of the network in which this contact is included can be supplied with power provided the corresponding individual switches of these appliances are closed.

The simultaneous closure of the switch 6 starts up the timer 4 for a previously programmed duration.

If the key-ring provided with its magnet 11 is maintained in position in the case 7, the switch 3 remains closed and the permanent supply of current to the coil 2 ensures the closure of a switch 1 so that all the appliances connected to the corresponding part of the mains can be supplied with current. Consequently, when the premises is occupied, the air conditioner operates permanently.

When the rod-shaped magnet 11, which is part of the key-ring 12, is withdrawn from the tube 7, it again starts up the timer 4. Thereafter, the switch 3 opens but, owing to the operation of the timer 4, the coil 2 remains supplied with current and the switch 1 is still closed during the operation of the timer.

Consequently, if the occupant of the premises must once again enter his room to obtain, for example, an object he had forgotten, and he does this during the operation of the timer, i.e. during about 3 min. from the moment he had left the room, he will be able to switch on the light normally. Moreover, the air conditioner operates during the operation of the timer.

When the period of time programmed in the timer has elapsed, the timer cuts off the supply to the coil 2 and the switch 1 opens and thus stops the supply of current to all the electric appliances connected to the part of the mains controlled thereby.

It will be necessary for the occupant of the room to once more introduce the magnet 11 into the tube 8 of the case 7 when he returns to the room in order to once again render operative the room lighting and the air conditioner.

Figure 2:
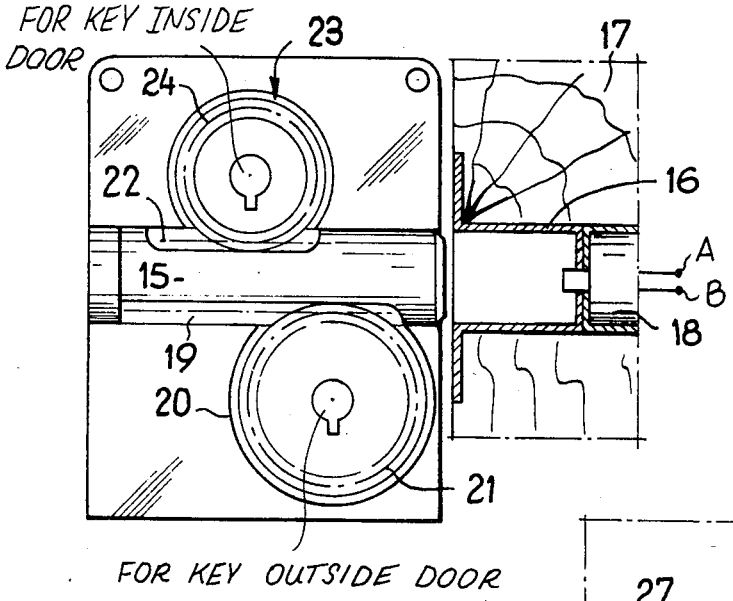
FIG. 2 is a sectional view of a lock which may be included in the construction of the supply control device according to the invention.

FIG. 2 shows a lock or latch which may be part of the construction of a supply control device of the type described with reference to FIG. 1.

The lock shown diagrammatically in FIG. 2 comprises a bolt 15 which is movable relative to a keeper 16 mounted in the post 17 of a door frame. Disposed at the inner end of the keeper 16 is a push-button switch 18 which may be connected in series in a supply conductor of the coil 2 actuating the contact 1 instead of switch 3 of the circuit of FIG. 1.

According to the embodiment illustrated in FIG. 2, the bolt 15 has a first rack 19 engaged with a gear pinion 20 which is rigid with a key cylinder 21 capable of being shifted by the key of the lock from outside of the door.

The bolt has a second rack 22 engaged with a gear pinion 23 of smaller diameter rigid with a key cylinder 24 which may be shifted by the key of the lock from inside the door.

The diameter of the gear pinion 20 is so calculated that, when the key cylinder 21 is turned through one rotation, it shifts the bolt 15 fully into the keeper 16 and consequently actuates the switch 18. In assuming that this switch is of the normally-closed type, the depression of its push-button opens the circuit in which it is connected and consequently cuts off the supply of current to the corresponding appliances.

On the other hand, if the lock is closed from inside the premises, by rotation of the cylinder 24, bearing in mind that the gear pinion 23 has a smaller diameter than the pinion 20, it shifts the bolt 15 to an extent sufficient to cause the bolt 15 to enter the keeper 16, but insufficient to actuate the switch 18, which consequently remains closed.

Consequently, when the door is closed from the interior, the appliances controlled by the switch 18 can remain supplied with current.

Figure 3:
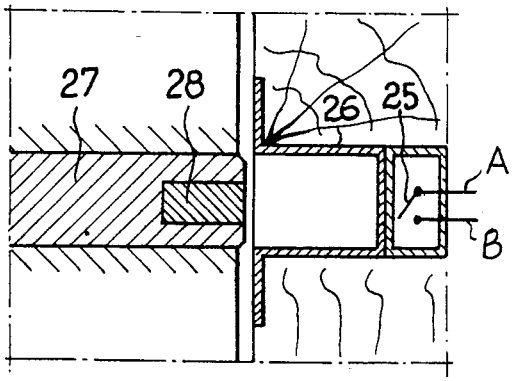
FIG. 3 is a partial sectional view of a lock similar to that shown in FIG. 2 provided with a magnetically controlled switch.

FIG. 3 shows a lock or latch whose switch 25 is of the magnetically-actuated type and may be substituted for the switch 3 of the circuit of FIG. 2. It is disposed at the inner end of a keeper 26 and has no apparent moving part, so that any tampering with the switch is precluded. A bolt 27 of the lock is made from a non-magnetic material and has at the end thereof facing the switch 25 at the end of the keeper 26 an actuating magnet 28.

With such an arrangement, it is found that any timer becomes superfluous.

Figure 4:
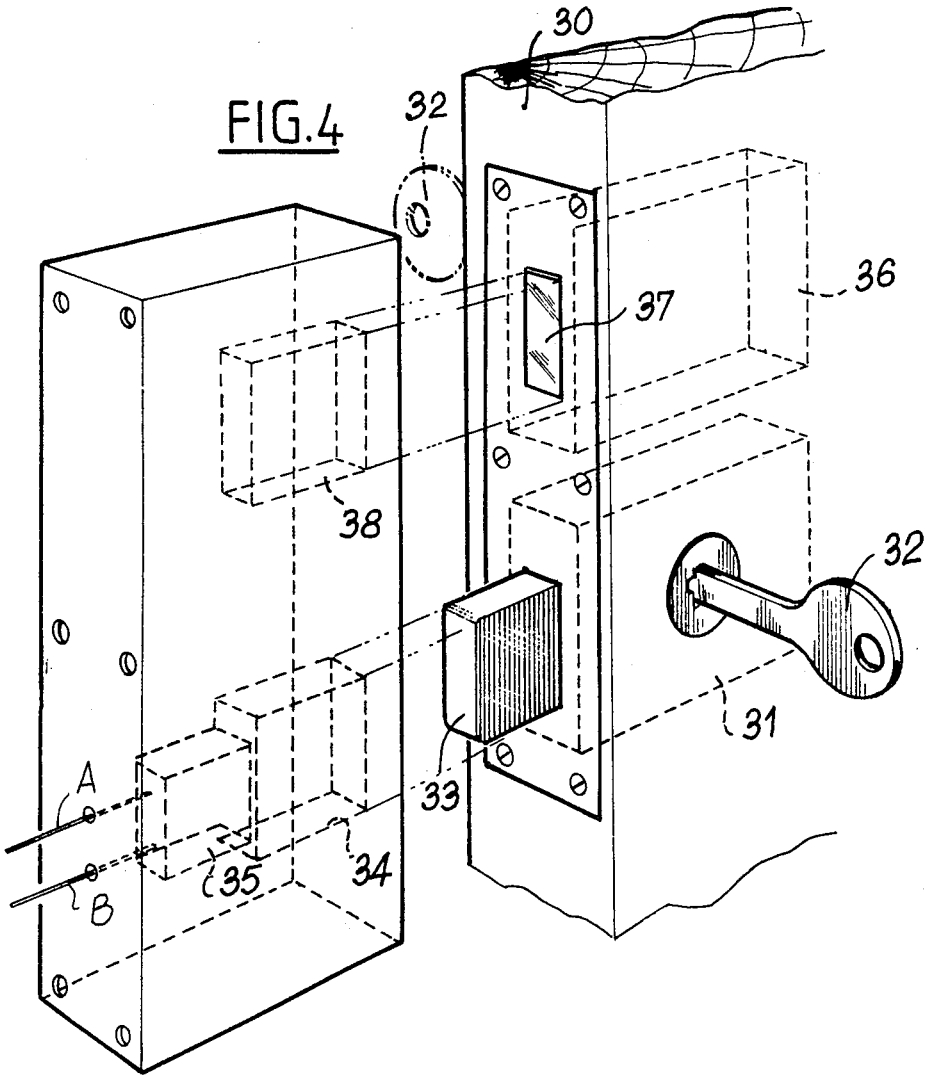
FIG. 4 is a diagrammatic perspective view of an arrangement of two locks which may be included in the construction of a control device according to the invention.

The arrangement shown in FIG. 4 is an assembly of two locks or latches which can be part of the construction of a supply control device according to an embodiment of the invention.

This arrangement comprises, mounted in a door post 30, a first lock 31 capable of being actuated from outside the door solely by means of a key 32, the bolt 33 of this lock being adapted to be engaged in a keeper 34 at the inner end of which is disposed a push-button switch 35 which is similar to the switch 18 of the lock shown in FIG. 2 and may be substituted for the switch 3 in th circuit shown in FIG. 1.

Also mounted in the post 30 is a second lock 36 capable of being operated solely from the interior by the same key 32, the bolt 37 of this lock being adapted to be engaged in a second keeper 38.

It can be seen that the actuation of the lock 31 from the exterior causes, when the bolt 33 penetrates into the keeper 34, the actuation of the switch 35 and consequently the opening of the circuit in which this switch is connected, and consequently the cutting off of the supply to the corresponding appliances.

On the other hand, when the lock 36 is actuated from the interior, all the appliances located within the corresponding premises remain supplied with current.

Figure 5:
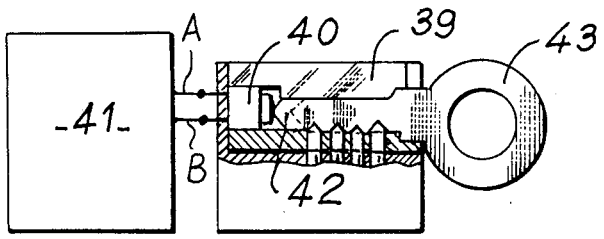
FIG. 5 is a sectional view of a selective control device for a part of the electric appliances of a premises in accordance with the type of key employed for gaining access to the premises.

FIG. 5 shows a device for selectively controlling some of the electric appliances contained in a premises in accordance with the type of key employed for gaining access to this premises. This device comprises, in association with a cylinder 39 of a lock such as that shown in FIG. 2 or of a lock 31 with which the switch 35 of the device shown in FIG. 5 is associated, a second push-button switch 40 connected in a circuit 41 controlling certain electric appliances disposed within the corresponding premises, such as for example the telephone unit.

In the embodiment shown in FIG. 5, the switch 40 is actuated by the end 42 of a special key 43 such as a pass-key usually in possession of the service staff of a hotel so as to prevent access of a member of this staff to these appliances by means of the control circuit 41.

On the other hand, the ordinary key possessed, for example, by a client of the hotel, has insufficient length to cause the actuation of the switch 40 so that the introduction of the key in the lock has no effect on the control circuit 41 and access to the appliances associated with this circuit remains available.

The arrangement just described permits an intermittent operation of at least certain electric appliances of a premises without necessity for the occupant of the premises to be concerned with this operation.

There may be associated with the device according to the invention an automatic time switch adapted to cancel the effects of the device during a predetermined period so as to ensure during this period the permanent supply of current to electric appliances such as the air conditioner, so as to maintain a suitable ambient temperature in the premises.

Although the invention just described has been considered to be essentially applied to the intermittent control of air conditioners, it may be applied to the control of any electric appliances which have a tendency to be left in operation by an oversight when leaving the premises in which they are installed.

I claim:

1. A device for controlling the selective switching on and off of supply of current to an electric appliance of a premises, in particular a hotel room, said device comprising:

a door lock including a bolt and a keeper to be mounted in a door and a door frame of an entrance to the premises such that said bolt is movable between first and second locked positions extending into said keeper and an unlocked position withdrawn from said keeper;

an electric circuit to connect a source of electric current to the electric appliance, said circuit including a switch normally closed to allow current to be supplied from the source to the appliance and operable to be opened to interrupt the supply of current from the source to the appliance, said switch being disposed in said keeper;

said door lock including first key-actuated means, operable only from a first side of said door lock corresponding to an exterior side of the door, for moving said bolt between said unlocked position and said first locked position, whereat said bolt extends into said keeper by an amount sufficient to open said switch and thereby interrupt the supply of current from the source to the appliance; and said door lock including second key-actuated means, operable only from a second side of said door lock corresponding to an interior side of the door, for moving said bolt between said unlocked position and said second locked position, whereat said bolt extends into said keeper by an amount sufficient to lock said door lock but insufficient to open said switch, such that said switch remains closed and current remains supplied from the source to the appliance.

2. A device as claimed in claim 1, wherein said switch comprises a push-button switch.

3. A device as claimed in claim 1, wherein said first key-actuated means comprises a first rack on said bolt, a first key cylinder extending from said first side of said door lock toward said bolt, and a first pinion meshing with said first rack and connected to said first key cylinder to be rotated upon key actuation thereof to thereby move said bolt between said unlocked and first locked positions, and said second key-actuated means comprises a second rack on said bolt, a second key cylinder extending from said second side of said door lock toward said bolt, and a second pinion meshing with said second rack and connected to said second key cylinder to be rotated upon key actuation thereof to thereby move said bolt between said unlocked and said second locked positions.

4. A device as claimed in claim 3, wherein said second pinion is of smaller diameter than said first pinion.

5. A device as claimed in claim 1, wherein said switch comprises a magnetically controlled switch, and said bolt has on an end thereof directed toward said switch an actuating magnet.

6. A device as claimed in claim 1, further comprising a second switch mounted within said first key-actuated means and forming part of another electric circuit to connect the current source to at least one appliance of the premises, the insertion of a normal key into said first key-actuated means being incapable of actuating said second switch, but said second switch being actuated by the insertion into said first key-operated means of a special key.

* * * * *

UNITED STATES PATENT AND TRADEMARK OFFICE

CERTIFICATE OF CORRECTION

PATENT NO. : 4,758,697

DATED : July 19, 1988

INVENTOR(S) : Patrick JEUNEU

It is certified that error appears in the above-identified patent and that said Letters Patent is hereby corrected as shown below:

ON THE TITLE PAGE:

On the Abstract page, change the Assignee name from "Societe Internationale de Promotion Commerciale" to --S.I.P.R.O.C. Societe Internationale de Promotion Commerciale--.

Signed and Sealed this

Fourteenth Day of March, 1989

*Attest:*

DONALD J. QUIGG

*Attesting Officer*

*Commissioner of Patents and Trademarks*